United States Patent [19]

Scherer

[11] Patent Number: 4,884,303

[45] Date of Patent: Dec. 5, 1989

[54] SLEEPING BAG

[75] Inventor: Michael J. Scherer, Boulder, Colo.

[73] Assignee: American Recreation Products, Inc., New Haven, Mo.

[21] Appl. No.: 166,109

[22] Filed: Mar. 10, 1988

[51] Int. Cl.[4] ..... A47G 9/08

[52] U.S. Cl. ..... 5/413; 2/69.5

[58] Field of Search ..... 2/69.5; 5/413, 416, 5/494, 498, 502

[56] References Cited

U.S. PATENT DOCUMENTS

| | | | |
|---|---|---|---|
| 1,426,230 | 8/1922 | Smith | 5/494 |
| 3,521,309 | 7/1970 | Evans | 5/494 X |
| 3,639,931 | 2/1972 | McGuire | 5/416 |
| 4,090,269 | 5/1978 | Hunt | 5/413 |
| 4,354,281 | 10/1982 | Satoh | 5/413 X |

*Primary Examiner*—Michael F. Trettel

*Attorney, Agent, or Firm*—Senniger, Powers, Leavitt and Roedel

[57] ABSTRACT

A sleeping bag comprising a pad and a cover with the cover comprising an upper and a lower section each comprising a layer of cushiony thermal insulation material, and an intermediate section comprising a layer of elastically stretchable material sandwiched between said upper and lower sections of the cover extending from one side of the cover to the other and secured at the side margins thereof to the cover, said intermediate elastically stretchable layer being operable to draw the lower section against the user in the bag to maintain the lower section in relatively close form-fitting relation to the user.

9 Claims, 3 Drawing Sheets

FIG.1
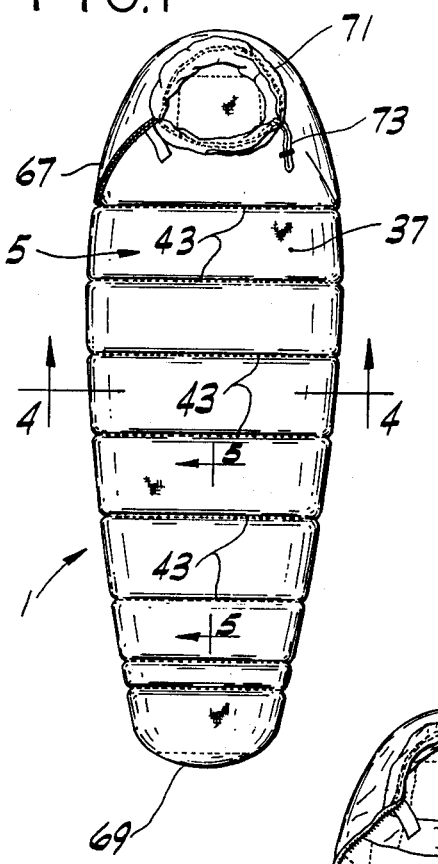
FIG.2
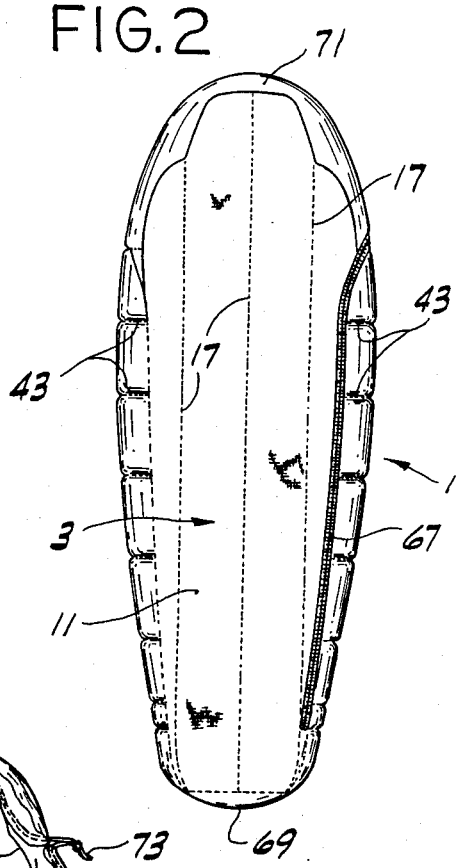
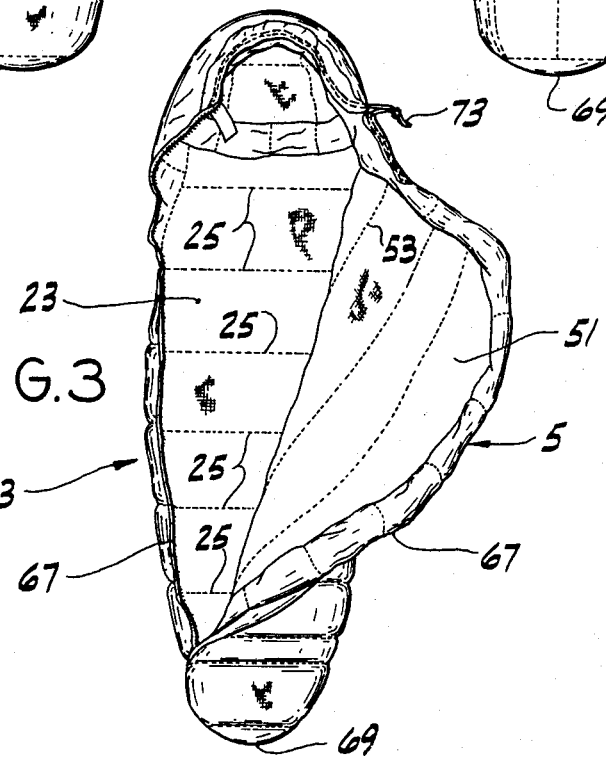
FIG.3

SLEEPING BAG

BRIEF SUMMARY OF THE INVENTION

This invention relates to sleeping bags, and more particularly to an insulated sleeping bag. It is especially directed to a type of sleeping bag generally comprising an outer shell and an inner liner with thermal insulation material, which may be a soft cushiony insulation material, incorporated therein. Heretofore, the construction of such a sleeping bag has been based on either a so-called "differential" cutting or "space filler" cutting of the shell and liner. "Differential" cutting refers to the cutting of the materials for the shell and liner in such manner that the girth of the liner is appreciably less than the girth of the shell. "Space filler" cutting refers to the cutting of the materials for the shell and liner in such manner that their girths are essentially equal. Generally, while differential cutting achieves excellent material usage, and bags made by differential cutting have high resistance to compression of the insulation by the user's elbows and knees and resultant "cold spots", differential cut bags have the disadvantage that they are not particularly form fitting, i.e. the bag stands away from the user rather than draping itself to the contours of the body of the user. This detracts from the ability of the bag to keep the user warm. While prior space filler cut bags contour well to the user, and thus avoid loss of warmth, they are prone to formation of "cold spots" by the user.

Among the several objects of this invention may be noted the provision of an improved insulated sleeping bag which has the desirable characteristic of a differential cut bag of resisting formation of "cold spots" by the user and the desirable characteristic of a space filler cut bag of draping to the contour of the body of the user for warmth; the provision of such a bag which has excellent warmth for its weight and a cozy feel; and the provision of such a bag which is readily washable.

In general, a sleeping bag of this invention has a bottom portion on which the user of the bag may lie and an upper portion adapted to serve as a cover for the user, the cover comprising an upper and a lower section, and an elastically stretchable layer between the upper and lower sections being operable to draw the lower section against the user in the bag to maintain the lower section in relatively close form-fitting relation to the user.

Other objects and featurs will be in part apparent and in part pointed out hereinafter.

BRIEF DESCRIPTION OF THE DRAWINGS

FIG. 1 is a view of the upper face of a sleeping bag of this invention considering the bag in a prone position, showing the bag closed;

FIG. 2 is a view of the bottom face of the bag;

FIG. 3 is a view similar to FIG. 1 showing the bag opened for entry (and exit) of the user;

Corresponding reference characters indicate corresponding parts throughout the several views of the drawings.

DETAILED DESCRIPTION

Figure 4:
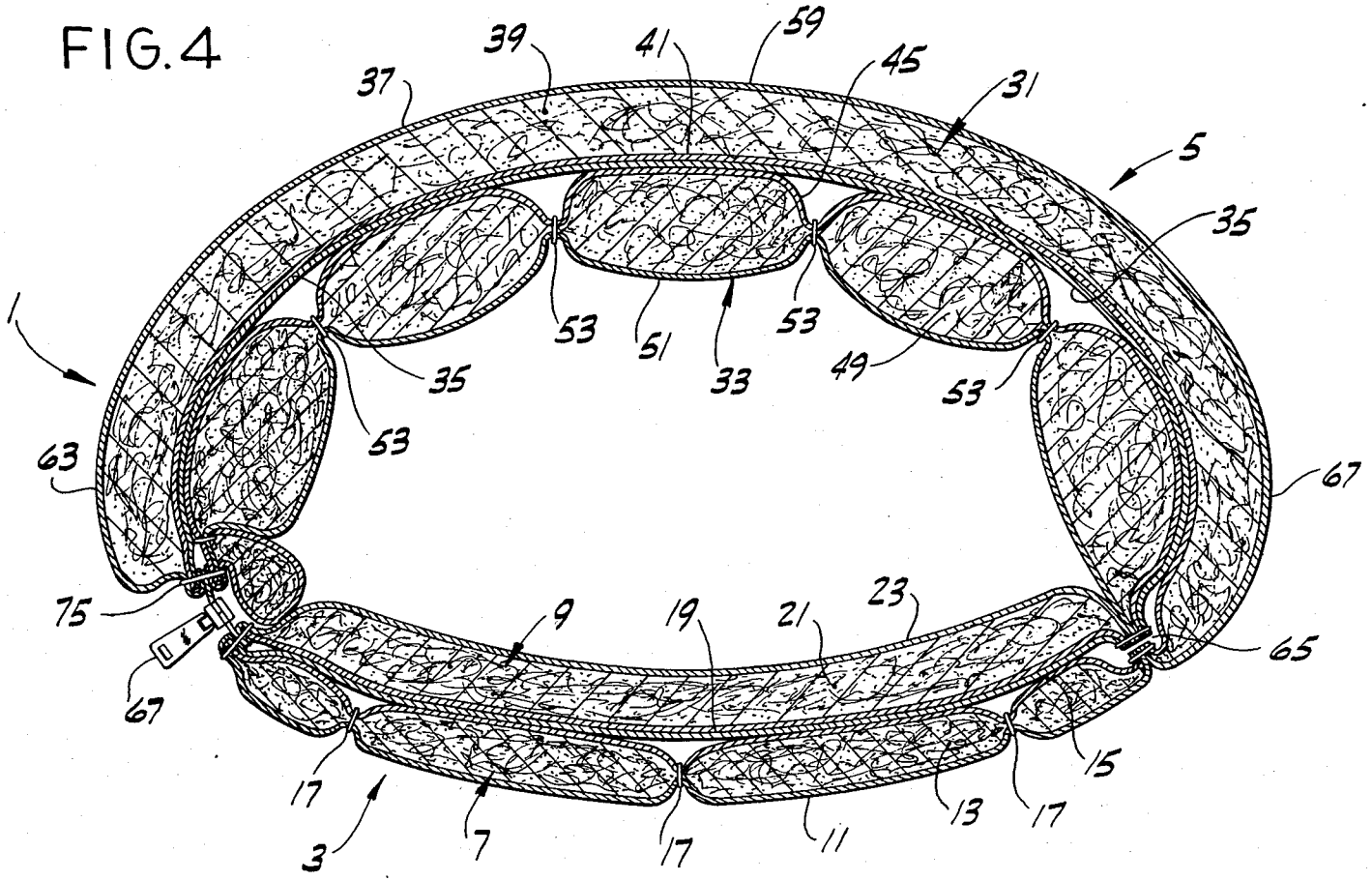
FIG. 4 is an enlarged transverse section on line 4—4 of FIG. 1.
Figure 5:
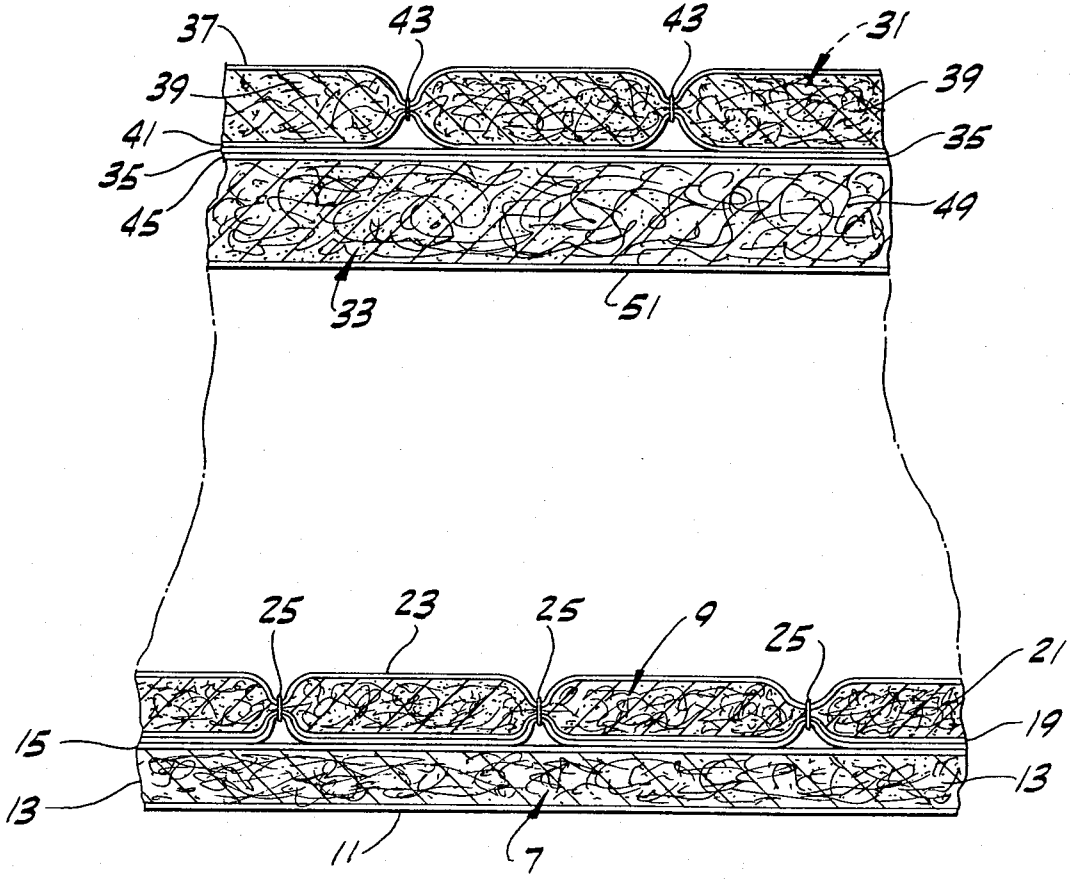
FIG. 5 is a view in longitudinal section on line 5—5 of FIG. 4.

Referring to the drawings, a sleeping bag of this invention, designated in its entirety by the reference numeral 1, is shown as having a lower or bottom portion generally designated 3, which may also be referred to as a pad, on which the user of the bag may lie and an upper portion generally designated 5 adapted to serve as a cover for the user.

The bottom portion or pad 3 has a multi-layer lower section 7, which is its outside section, and a multi-layer upper section 9, which is its inside section. The lower section 7 comprises a lower layer 11 (the bottom layer of the bag) of suitable flexible material for the outside of the bag, an intermediate layer 13 which may be a layer of cushiony thermal insulation material, and an upper layer 15 of flexible material for enclosure of the insulation material, these layers being seamed together by stitching on lines as indicated at 17 for quilting purposes to preserve the integrity of the insulation material. The upper section 9 comprises a lower layer 19 of flexible material which may be the same as the layer 15, an intermediate layer 21 of cushiony thermal insulation material which may be the same as layer 13, and an upper layer 23 of suitable flexible material for the inside of the bag, these layers being seamed together by stitching on lines as indicated at 25 for quilting purposes to preserve the integrity of the layer 21. Layer 19 may be a double layer, as shown. The layers of the lower section may be stitched adjacent their margins and the layers of the upper section may be stitched together adjacent their margins. As illustrated, by way of example, the lines of stitching 17 of the lower section of the pad extend lengthwise of the pad from one end thereof to the other and the lines of switching 25 of the upper section of the pad extend transversely of the pad from one side thereof to the other, the lines 17 and 25 thus being at right angles to each other.

The cover 5 of the bag has a multi-layer upper section 31, which is its outside section, a multi-layer lower section 33, which is its inside section, and an intermediate section 35 comprising an elastically stretchable layer sandwiched between said upper and lower sections 31 and 33 extending from one side of the cover to the other and secured at the side margins thereof to the cover and being free of the upper and lower sections 31 and 33 between the side margins. The upper section 31 comprises an upper layer 37 of suitable flexible material, which may be same as layer 11, for the outside of the bag, an intermediate layer 39 of cushiony thermal insulation material, and a lower layer 41 of flexible material for enclosure of the insulation material, these layers being seamed together by stitching on lines as indicated 43 to preserve the integrity of layer 39. The lower section 33 comprises an upper layer 45 of flexible material, which may be the same as layer 41, an intermediate layer 49 of cushiony thermal insulation material, which may be the same as layer 39, and a lower layer 51 of flexible material, which may be the same as layer 23, suitable for the inside of the bag, these layers being seamed together by stitching on lines as indicated at 53 for quilting purposes to preserve the integrity of the layer 49. The layers of the upper section 31 may be stitched together adjacent their margins, and the layers of the lower section may be stitched together adjacent their margins. As illustrated, the lines of stitching 43 of the upper section 31 extend transversely of the upper section from one side thereof to the other, and the lines of stitching 53 of the lower section 33 extend lengthwise of the lower section, the lines 43 and 53 thus being at right angles to each other.

The portion 3 forms the bottom of the sleeping bag and the cover 5 forms the top and sides of the bag, the cover 5 having a top portion 59 and side portions 61 and 63 extending down toward the side margins of the bottom portion. The side portion 61 of the cover is permanently joined as by stitching indicated at 65 to the respective side margin of the bottom portion. The lower side margin of the other side portion 63 of the cover and the other side margin of the bottom portion have means indicated at 67, more particularly slide fastener means, for closing the bag at said other side and permitting opening of the bag along said other side for ingress and egress of the user. A draft tube is indicated at 68. The bag is permanently closed at its foot end as indicated at 69. At the head end of the bag the bottom portion 3 is provided with a hood 71 for the head of the user, the hood having a drawstring 73 for drawing it snugly around the head. The bag is shaped generally to conform to the outline of the body, tapering toward its foot end as appears in FIGS. 1 and 2, and being adapted to snug around the feet for insuring warmth for the feet.

The layers of the cover 5 are so dimensioned and stitched together that, with the user in the bag and with the bag closed by the slide fastener 67, the lower section 33 of the cover is adapted to be snugged against the user by the elastic action of the layer 35, the latter being caught at one side in the stitching at 65 securing the side portion 61 of the cover to the respective side margin of the pad 3, and at its other side to the respective side margin of the lower section of the cover by stitching as indicated 75.

The layers 11 and 37, which are the outside layers of the bag, are cut from a suitable fabric such as nylon taffeta. The cushiony thermal insulation layers at 13, 21, 39 and 49 are batts of a fluffy fibrous thermal insulation material such as that sold by E.I. DuPont de Nemours & Co. under the trade name QUALLOFIL. The layers 19, 41 45 and 47 are cut from a suitable fabric such as spunbonded nylon. The layers 23 and 51, which are the inside liner layers of the bag, are cut from a suitable fabric such as a heat-reflective aluminized polyester fabric, i.e. a polyester fabric coated on one face with aluminum, and incorporated in the bag with the heat-reflective face thereof toward the inside. The elastically stretchable layer 35 may be cut from a suitable stretchable fabric such as nylon tricot. It could be part stretchable and part non-stretchable. In either case, it could have means for limiting its stretch. It functions when the user is sleeping in the bag (with the bag closed) to draw the lower section 33 of the cover 5 against the user to maintain the lower section 33 in relatively close form-fitting relation to the user thereby excellently to keep the user warm while, at the same time, the bag has a cozy feel and is resistant to being punched out by the user's elbows and knees. As an additional benefit, the nylon tricot layer, being relatively slippery, reduces friction between the upper and lower sections of the cover, effecting improved loft of the insulation material in these sections.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. A sleeping bag having a bottom portion, on which the user of the bag may lie, and an upper portion adapted to serve as a cover for the user, the cover comprising an upper and a lower section, and an elastically stretchable layer between said upper and lower sections of the cover operable to draw the lower section against the user in the bag to maintain it in relatively close form-fitting relation to the user;

each of the upper and lower sections of the cover having opposite side margins and comprising a layer of cushiony thermal insulation material, the elastically stretchable layer being sandwiched between said upper and lower sections of the cover extending from one side margin thereof to the other side margin thereof and secured in place at the side margins of the cover;

said elastically strechable layer being free of said sections between said side margins.

2. A sleeping bag as set forth in claim 1 wherein the upper section of the cover has an upper layer of flexible material at the top of its layer of cushiony material and a lower layer of flexible material at the bottom of its layer of cushiony material, and the lower section of the cover has an upper layer of flexible material at the top of its layer of cushiony material and a lower layer of flexible material at the bottom of its layer of cushiony material, said elastically stretchable layer lying between the lower layer of the upper section and the upper layer of the lower section.

3. A sleeping bag as set forth in claim 2 wherein the layers of the upper section of the cover are seamed together along first lines of seam extending in one direction relative to the bag and the layers of the lower section are seamed together along second lines of seam extending at an angle to the first lines.

4. A sleeping bag as set forth in claim 3 wherein the first lines of seam extend transversely of the bag and the second lines of seam extend longitudinally of the bag.

5. A sleeping bag having a bottom portion, on which the user of the bag may lie, and an upper portion adapted to serve as a cover for the user, the cover comprising an upper and a lower section, and an elastically stretchable layer between said upper and lower sections of the cover operable to draw the lower section against the user in the bag to maintain it in relatively close form-fitting relation to the user;

said bottom portion of the bag having opposite side margins;

each of the upper and lower sections of the cover having opposite side margins and comprising a layer of cushiony thermal insulation material, the elastically stretchable layer being sandwiched between said upper and lower sections of the cover extending from one side margin thereof to the other side margin thereof and secured in place at the side margins of the cover;

the cover having a top portion and side portions extending down toward the side margins of said bottom portion of the bag, each side portion having a lower margin, one of said side portions being permanently joined at its lower margin to the respective side margin of the bottom portion at the respective side of the bag, the lower margin of the other side portion of the cover and the other side margin of the bottom portion having means for closing the bag at the other side and permitting opening of the bag along said other side for ingress and egress of the user, the bag being permanently closed at one end constituting its foot end;

the upper section of the cover having an upper layer of flexible material at the top of its layer of cushiony material and a lower layer of flexible material at the bottom of its layer of cushiony material, and the lower section of the cover having an upper layer of flexible material at the top of its layer of cushiony material and a lower layer of flexible material at the bottom of its layer of cushiony material, said elastically stretchable layer lying between the lower layer of the upper section and the upper layer of the lower section;

said elastically stretchable layer being free of the upper and lower sections.

6. A sleeping bag as set forth in claim 5 wherein said elastically stretchable layer is a layer of woven stretchable fabric material which is relatively slippery.

7. A sleeping bag as set forth in claim 6 wherein said elastically stretchable layer is a layer of nylon tricot.

8. A sleeping bag having a bottom portion, on which the user of the bag may lie, and an upper portion adapted to serve as a cover for the user, the cover comprising an upper and a lower section, and an elastically stretchable layer between said upper and lower sections of the cover operable to draw the lower section against the user in the bag to maintain it in relatively close form-fitting relation to the user;

said bottom portion of the bag having opposite side margins;

each of the upper and lower sections of the cover having opposite side margins and comprising a layer of cushiony thermal insulation material, the elastically stretchable layer being sandwiched between said upper and lower sections of the cover extending from one side margin thereof to the other side margin thereof and secured in place at the side margins of the cover;

the cover having a top portion and side portions extending down toward the side margins of said bottom portion of the bag, each side portion having a lower margin, one of said side portions being permanently joined at its lower margin to the respective side margin of the bottom portion at the respective side of the bag, the lower margin of the other side portion of the cover and the other side margin of the bottom portion having means for closing the bag at the other side and permitting opening of the bag along said other side for ingress and egress of the user, the bag being permanently closed at one end constituting its foot end;

the upper section of the cover having an upper layer of flexible material at the top of its layer of cushiony material and a lower layer of flexible material at the bottom of its layer of cushiony material, and the lower section of the cover having an upper layer of flexible material at the top of its layer of cushiony material and a lower layer of flexible material at the bottom of its layer of cushiony material, said elastically stretchable layer lying between the lower layer of the upper section and the upper layer of the lower section;

the bottom portion thereof having a lower section comprising a layer of cushiony thermal insulation material, a lower layer of flexible material at the bottom and an upper layer of flexible material at the top thereof, and an upper section comprising a layer of cushiony thermal insulation material, a lower layer of flexible material at the bottom and an upper layer of flexible material at the top thereof;

the lower layer of the lower section of the cover being a fabric which is heat-reflective at its lower surface and the upper layer of the upper section of the bottom portion being a fabric which is heat-reflective at its upper surface;

the layer of the upper section of the cover being seamed together along first lines of seam extending in one direction relative to the bag, the layers of the lower section of the cover are seamed together along second lines of seam extending at an angle to the first lines, the layers of the lower section of the bottom portion are seamed together along third lines of seam extending in one direction relative to the bag, and the layers of upper section of the bottom portion are seamed together along fourth lines of seam extending at an angle to the third lines.

9. A sleeping bag as set forth in claim 8 wherein said first lines of seam extend transversely of the bag, said second lines extend longitudinally of the bag, said third lines extend longitudinally of the bag, and said fourth lines extend transversely of the bag.

* * * * *